US010855028B1

(12) United States Patent
Henry et al.

(10) Patent No.: US 10,855,028 B1
(45) Date of Patent: Dec. 1, 2020

(54) PLUG CONNECTOR

(71) Applicant: TE CONNECTIVITY CORPORATION, Berwyn, PA (US)

(72) Inventors: Randall Robert Henry, Lebanon, PA (US); Michael John Phillips, Camp Hill, PA (US); Tracy Lee Smith, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/524,396

(22) Filed: Jul. 29, 2019

(51) Int. Cl.
*H01R 13/631* (2006.01)
*H01R 13/66* (2006.01)
*H01R 13/627* (2006.01)

(52) U.S. Cl.
CPC ..... *H01R 13/631* (2013.01); *H01R 13/6272* (2013.01); *H01R 13/665* (2013.01)

(58) Field of Classification Search
CPC . H01R 13/631; H01R 13/6272; H01R 13/665
USPC ..... 439/357
See application file for complete search history.

(56) References Cited

U.S. PATENT DOCUMENTS 4,477,138 A * 10/1984 Andrews, Jr. ..... H01R 12/7005 439/374
5,388,995 A * 2/1995 Rudy, Jr. ..... H05K 7/1449 439/61
6,302,744 B1 * 10/2001 Nomura ..... H01R 13/64 439/680
7,114,980 B1 * 10/2006 Wu ..... H01R 13/6275 439/352
7,198,519 B2 * 4/2007 Regnier ..... H01R 12/725 439/637
7,354,292 B1 * 4/2008 Lloyd ..... H01R 13/6272 439/352
7,878,844 B2 * 2/2011 Weidner ..... H01R 13/743 439/533
8,152,566 B1 * 4/2012 Little ..... H01R 13/6582 439/607.41
8,231,400 B2 * 7/2012 Phillips ..... G02B 6/4284 439/357
8,562,373 B2 * 10/2013 Wu ..... H01R 13/6658 439/352
8,636,544 B1 * 1/2014 Briant ..... H01R 13/514 439/607.25

(Continued)

*Primary Examiner* — Alexander Gilman

(57) ABSTRACT

A plug connector includes a plug housing having a mating end at a front of the plug housing for mating with a mating connector. The plug housing has an upper wall, an end wall extending from the upper wall, and side walls extending from the upper wall. The plug housing has a mating chamber defined by the upper wall, the end wall and the side walls. The mating chamber is open at the front. The end wall is opposite the front at a rear of the mating chamber. The plug connector includes a circuit card held by the plug housing. The circuit card extends into the mating chamber for mating with the mating connector. The circuit card has plug contacts. The plug connector includes a mating spring coupled to the end wall. The mating spring has a spring arm extending into the mating chamber. The spring arm has a mating interface configured to engage a mating end of the mating connector to bias the end wall away from the mating end of the mating connector.

20 Claims, 4 Drawing Sheets

(56) References Cited

U.S. PATENT DOCUMENTS 8,858,237 B2 * 10/2014 Hsu ..... H01R 12/724 439/60
9,130,308 B2 * 9/2015 Wang ..... H01R 13/6275
9,419,367 B2 * 8/2016 Henry ..... H01R 9/034
9,490,595 B2 * 11/2016 Little ..... H01R 24/60
9,502,817 B2 * 11/2016 Kim ..... H01R 13/6205
9,728,871 B1 * 8/2017 Gutgold ..... H01R 13/6275
9,755,368 B2 * 9/2017 Cheng ..... H05K 1/117
10,211,573 B2 * 2/2019 Zhao ..... H01R 43/20
10,236,605 B1 * 3/2019 Henry ..... H01R 12/732
10,263,349 B2 4/2019 Phillips et al.
10,276,976 B1 4/2019 Phillips et al.
10,276,988 B2 * 4/2019 Zhao ..... H01R 13/631
10,367,299 B2 * 7/2019 Yao ..... H01R 13/6272
10,320,100 B2 8/2019 Phillips
10,403,565 B1 * 9/2019 Henry ..... H01L 23/49541
10,454,194 B1 * 10/2019 Phillips ..... H01R 13/629
10,454,203 B2 10/2019 Phillips et al.
10,547,142 B1 * 1/2020 Henry ..... H01R 13/635
10,880,363 6/2020 Philips et al.
2003/0148636 A1 * 8/2003 Henry ..... G01V 11/002 439/10
2003/0198025 A1 * 10/2003 Cao ..... G02B 6/4284 361/728
2005/0142902 A1 * 6/2005 Juret ..... G06K 7/0047 439/76.1
2006/0160429 A1 * 7/2006 Dawiedczyk ..... H01R 12/7023 439/676
2006/0189180 A1 * 8/2006 Lang ..... H01R 43/00 439/76.1
2012/0231661 A1 * 9/2012 Song ..... H01R 12/724 439/607.4
2013/0288496 A1 * 10/2013 Ma ..... H01R 13/633 439/159
2014/0011381 A1 * 1/2014 Liang ..... G06K 7/0021 439/159
2015/0318633 A1 * 11/2015 Herring ..... H01R 13/4538 439/140
2016/0126660 A1 * 5/2016 Henry ..... H01R 13/5845 439/606
2016/0126678 A1 * 5/2016 Phillips ..... H01R 13/6585 439/607.09
2016/0233594 A1 * 8/2016 Zhao ..... H01R 13/6581
2016/0294105 A1 * 10/2016 Zhao ..... H01R 12/724
2016/0344143 A1 * 11/2016 Guo ..... H05K 1/0292
2017/0302031 A1 * 10/2017 Cheng ..... H01R 13/6581
2018/0040972 A1 * 2/2018 Phillips ..... H01R 12/737
2018/0233855 A1 * 8/2018 Phillips ..... H01R 12/7029
2019/0237912 A1 * 8/2019 Little ..... H01R 13/6585
2019/0280419 A1 * 9/2019 Henry ..... H01R 13/6593
2020/0194932 A1 * 6/2020 Henry ..... H01R 13/6272

* cited by examiner

PLUG CONNECTOR

BACKGROUND OF THE INVENTION

The subject matter herein relates generally to plug connectors.

Communication systems including mating connectors configured to be separably mated for data and/or power transmission through the connector system. For example, the connector systems typically include complementary plug connectors and receptacle connectors configured to be mated to and unmated from each other. The connectors typically include latching features to secure mating of the plug connector with the receptacle connector. For example, the plug connector may include a deflectable latch configured to be received in a latch opening of the receptacle connector. The plug connector includes plug contacts and the receptacle connector includes receptacle contacts. The plug and receptacle contacts are mated in a mating direction and have sufficient length along the mating direction for contact wipe. However, portions of the plug contacts forward of the mating interface creates electrical stubbing, which degrades the signals and performance of the communication system. Additionally, when overmated, the additional travel causes the latches to become unseated leading to movement between the connectors.

A need remains for a reliable plug connector for a communication system.

BRIEF DESCRIPTION OF THE INVENTION

In one embodiment, a plug connector is provided. The plug connector includes a plug housing having a mating end at a front of the plug housing for mating with a mating connector. The plug housing has an upper wall, an end wall extending from the upper wall, and side walls extending from the upper wall. The plug housing has a mating chamber defined by the upper wall, the end wall and the side walls. The mating chamber is open at the front. The end wall is opposite the front at a rear of the mating chamber. The plug connector includes a circuit card held by the plug housing. The circuit card extends into the mating chamber for mating with the mating connector. The circuit card has plug contacts. The plug connector includes a mating spring coupled to the end wall. The mating spring has a spring arm extending into the mating chamber. The spring arm has a mating interface configured to engage a mating end of the mating connector to bias the end wall away from the mating end of the mating connector.

In another embodiment, a plug connector is provided. The plug connector includes a plug housing having a mating end at a front of the plug housing for mating with a mating connector. The plug housing has an upper wall, an end wall extending from the upper wall, and side walls extending from the upper wall. The plug housing has a mating chamber defined by the upper wall, the end wall and the side walls. The mating chamber is open at the front. The end wall is opposite the front at a rear of the mating chamber. The plug housing has a latch pocket at the upper wall. The plug connector includes a circuit card held by the plug housing. The circuit card extends into the mating chamber for mating with the mating connector. The circuit card has plug contacts. The plug connector includes a latch received in the latch pocket. The latch has a latch beam including a latching tip configured to be received in a latch opening of the mating connector to secure the plug connector to the mating connector. The plug connector includes a mating spring coupled to the end wall. The mating spring has a spring arm extending into the mating chamber. The spring arm has a mating interface configured to engage a mating end of the mating connector to bias the end wall away from the mating end of the mating connector to seat the latching tip against the mating connector within the latch opening.

In a further embodiment, a communication system is provided. The communication system includes a receptacle connector including an outer housing having a cavity and a communication connector received in the cavity of the outer housing. The communication connector includes a connector body holding receptacle contacts. The connector body includes a card slot at a mating end of the communication connector. The receptacle contacts are arranged within the card slot. The outer housing includes a latching feature including a latch opening. The communication system includes a plug connector coupled to the receptacle connector. The plug connector includes a plug housing having a mating end at a front of the plug housing for mating with the receptacle connector. The plug housing has an upper wall, an end wall extending from the upper wall, and side walls extending from the upper wall. The plug housing has a mating chamber defined by the upper wall, the end wall and the side walls. The end wall is opposite the front at a rear of the mating chamber. The mating chamber is open at the front to receive the communication connector. The plug housing has a latch pocket at the upper wall. The plug connector includes a circuit card held by the plug housing. The circuit card extends into the mating chamber for mating with the card slot of the communication connector. The circuit card has plug contacts mated with the receptacle contacts. The plug connector includes a latch received in the latch pocket. The latch has a latch beam including a latching tip received in the latch opening of the outer housing to secure the plug connector to the receptacle connector. The plug connector includes a mating spring coupled to the end wall. The mating spring has a spring arm extending into the mating chamber. The spring arm has a mating interface engaging the mating end of the communication connector to bias the end wall away from the mating end of the communication connector to seat the latching tip against the outer housing within the latch opening.

DETAILED DESCRIPTION OF THE INVENTION

Figure 1:
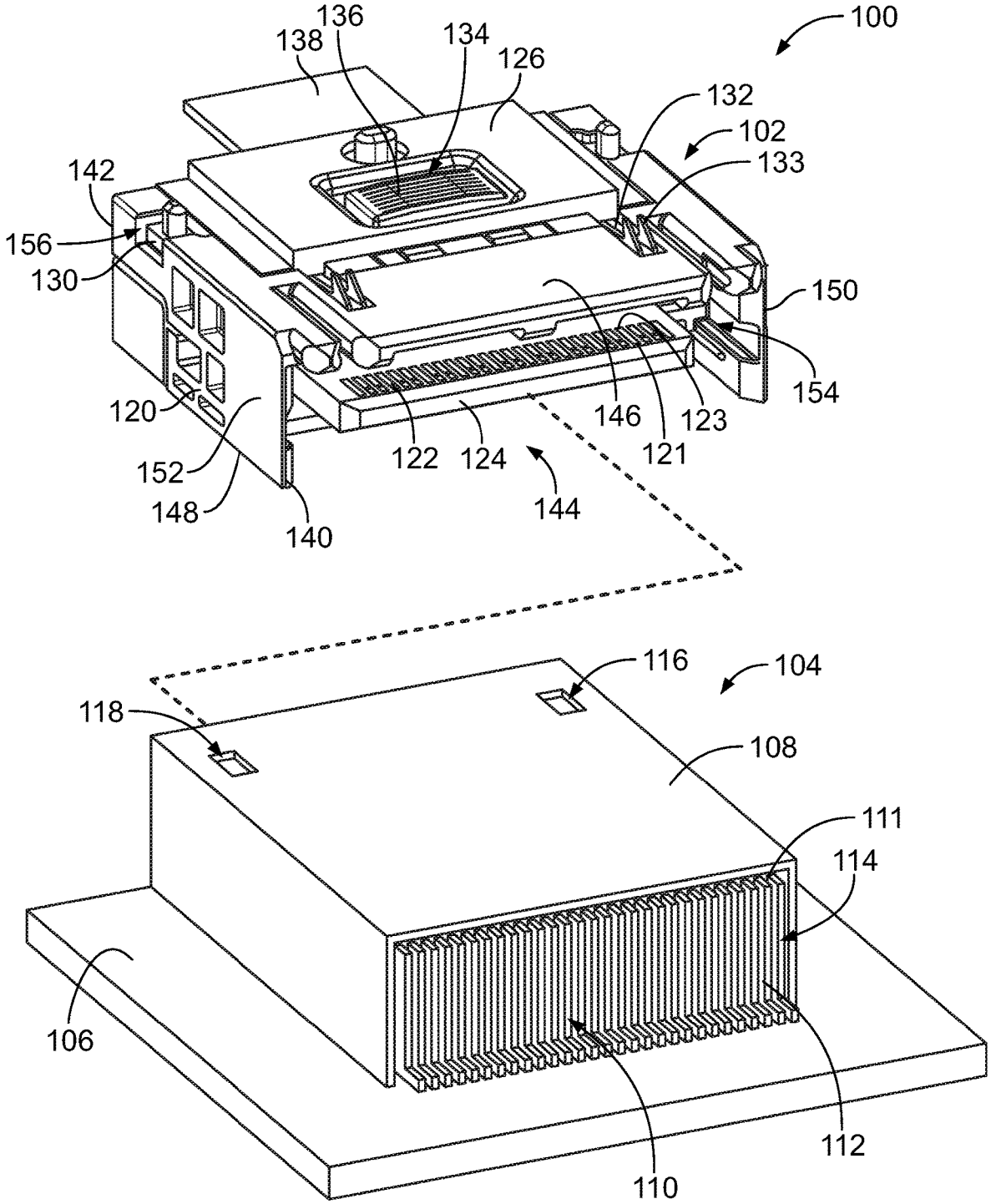
FIG. 1 illustrates a connector system formed in accordance with an exemplary embodiment.
Figure 2:
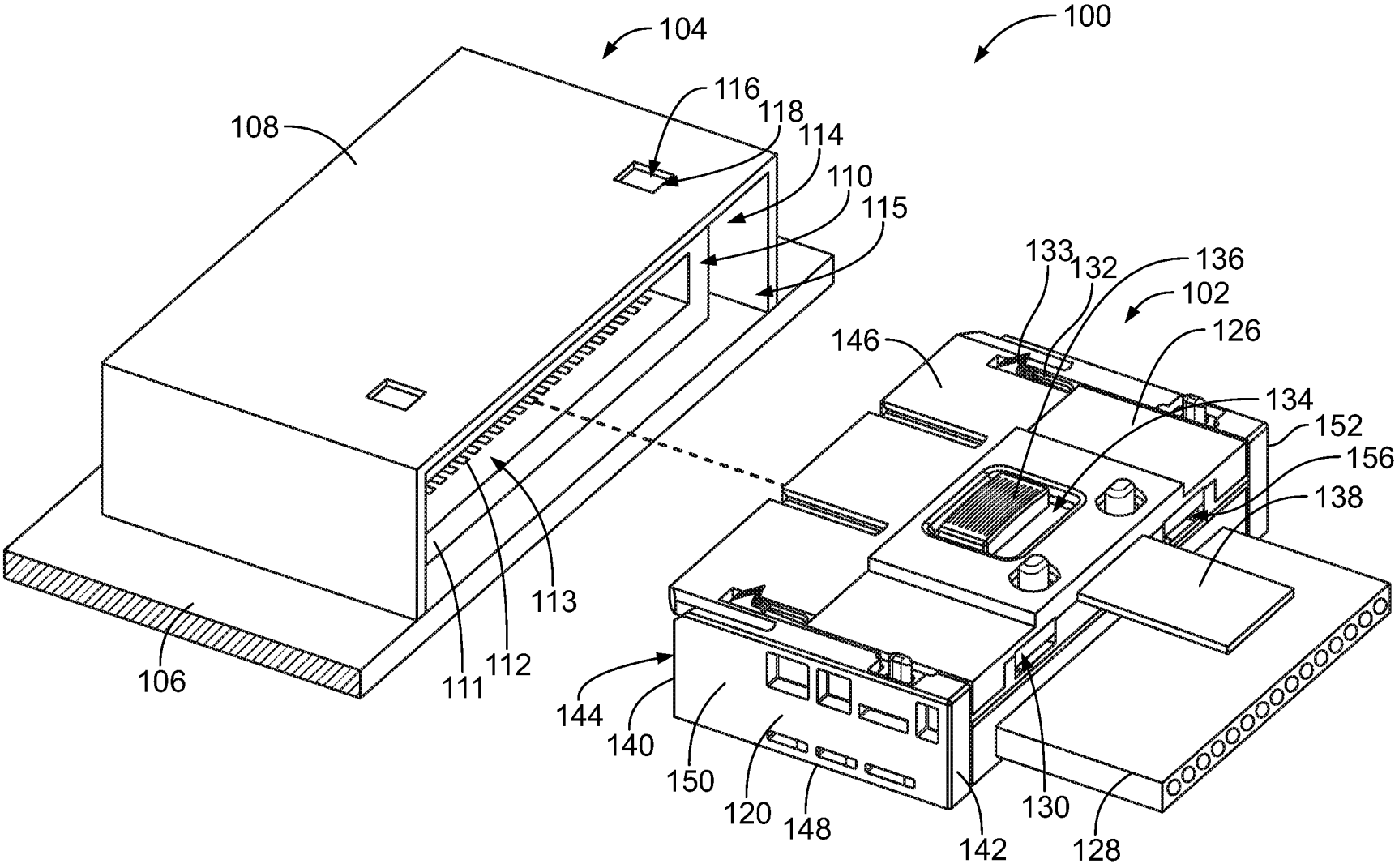
FIG. 2 illustrates a connector system formed in accordance with an exemplary embodiment.

FIGS. 1 and 2 illustrate a communication system 100 formed in accordance with an exemplary embodiment. The communication system 100 includes a plug connector 102 and a receptacle connector 104. The plug connector 102 is configured to be mated with the receptacle connector 104 at a separable mating interface. The receptacle connector 104 defines a mating connector for the plug connector 102. FIG. 1 is a front view of the plug connector 102. FIG. 2 is a rear view of the plug connector 102.

In an exemplary embodiment, the receptacle connector 104 is mounted to a circuit board 106. The receptacle connector 104 includes an outer housing 108 and a communication connector 110 received in the outer housing 108. The communication connector 110 includes a connector body 111 holding receptacle contacts 112 configured to be mated with the plug connector 102. In the illustrated embodiment, the outer housing 108 includes a cavity 114 that receives the communication connector 110. When the plug connector 102 is mated with the receptacle connector 104, the cavity 114 receives a portion of the plug connector 102. The receptacle connector 104 includes latching features 116 for latchably securing the plug connector 102 to the receptacle connector 104. In the illustrated embodiment, the latching features 116 include latch openings 118 in the outer housing 108 configured to receive complementary latching features of the plug connector 102.

In an exemplary embodiment, the communication connector 110 is a card edge connector. For example, the communication connector 110 includes a card slot 113 at a mating end 115 of the communication connector 110. The card slot 113 is configured to receive a circuit card of the plug connector 102. The receptacle contacts 112 are arranged in the card slot 113 for mating with the plug connector 102. In the illustrated embodiment, the receptacle contacts 112 are spring beam contacts configured to be mated with the circuit card. However, the receptacle contacts 112 may be other types of contacts in alternative embodiments, such as contact pads. In other various embodiments, the communication connector 110 of the receptacle connector 104 may hold a circuit card configured to be mated with the plug connector 102. For example, the receptacle contacts 112 may be contact pads on the circuit card.

The plug connector 102 includes a plug housing 120 holding plug contacts 122 (FIG. 1) configured to be mated with corresponding receptacle contacts 112 of the receptacle connector 104. In the illustrated embodiment, the plug connector 102 includes a circuit card 124 configured to be plugged into the card slot 113 of the communication connector 110. The plug contacts 122 are contact pads at a card edge of the circuit card 124. Each plug contact 122 extends between a front end 121 and a rear end 123. The receptacle contact 112 is configured to be mated to the plug contact 122 between the front end 121 and the rear end 123. During mating, the receptacle contact 112 wipes along the plug contact 122 from the front end 121 to the mating interface with the plug contact 122. In an exemplary embodiment, the plug connector 102 is configured to be mated with the receptacle connector 104 such that lengths of electrical stubs of the plug contacts 122 between the mating interface and the front end 121 are reduced to enhance electrical performance of the plug connector 102. For example, in an exemplary embodiment, the plug connector 102 includes features that rearward bias the plug connector 102 relative to the receptacle connector 104 to shorten the length of the electrical stub when mated. The plug contacts 122 may be other types of contacts in alternative embodiments, such as spring beams. In other various embodiments, the plug housing 120 of the plug connector 102 may include a card slot configured to receive a circuit card of the receptacle connector 104 and the plug housing 120 may hold discrete plug contacts 122, such as spring beam contacts, for mating to the circuit card or other types of mating contacts.

The plug connector 102 includes a cover 126 coupled to the plug housing 120. The cover 126 closes the plug housing 120, such as at the top of the plug housing 120. The cover 126 may be used to secure the circuit card 124 in the plug housing 120.

In an exemplary embodiment, the plug connector 102 includes cables 128 extending from the rear of the plug housing 120. The cables 128 are electrically connected to corresponding plug contacts 122. For example, the cables 128 may be terminated to the circuit card 124, such as by soldering.

The plug connector 102 includes a latch 130 for latchably securing the plug connector 102 to the receptacle connector 104. The latch 130 is coupled to the plug housing 120. The latch 130 may be secured in the plug housing 120 using the cover 126. For example, the cover 126 may cover a portion of the latch 130. In the illustrated embodiment, the latch 130 includes latch beams 132 having latching tips 133 configured to be received in the latch openings 118 of the receptacle connector 104.

The plug connector 102 includes an actuator 134 operably coupled to the latch 130 for actuating the latch 130 to move the latch beams 132 between latched positions and unlatched positions, such as to release the plug connector 102 from the receptacle connector 104. The actuator 134 may be coupled to the plug housing 120 and/or the cover 126. In the illustrated embodiment, the actuator 134 includes a push button 136 for actuating the latch 130 and a pull tab 138 for actuating the latch 130. However, in other various embodiments, the actuator 134 may be provided without the push button 136 and/or without the pull tab 138 and may include other types of actuating features. The push button 136 causes actuation of the latch 130 by pushing the latch 130 inward or downward to cause the latch beams 132 to move to unlatched positions. For example, an inner surface of the actuator 134 engages the latch 130 to push the latch 130 inward. The latch beams 132 are moved inward or downward when the push button 136 is pushed inward. The latch 130 may be pivoted or rotated to move the latch beams 132. The pull tab 138 causes actuation of the latch 130 by pushing the latch 130 inward or downward to cause the latch beams 132 to move to unlatched positions. For example, an inner surface of the actuator 134 may be ramped and pulled rearward with the pull tab 138 to engage the latch 130 to push the latch 130 inward. The latch beams 132 are moved inward or downward when the pull tab 138 is pulled rearward.

The plug housing 120 extends between a front 140 and a rear 142. The plug contacts 122 (shown in FIG. 1) may be located proximate to the front 140 for mating with the receptacle connector 104. In an exemplary embodiment, the plug housing 120 has a mating end 144 at the front 140 for mating with the mating connector defined by the receptacle connector 104.

The plug housing 120 includes an upper wall 146 at a top of the plug housing 120. The plug housing 120 includes a bottom 148 opposite the upper wall 146. The latch 130 is provided at the upper wall 146. The cover 126 is coupled to the plug housing 120 at the upper wall 146. The plug housing 120 includes a first side wall 150 and a second side wall 152 opposite the first side 150. The first and second sides walls 150, 152 extend from the upper wall 146 to the bottom 148. In various embodiments, the plug housing 120 may be generally rectangular shaped; however, other shapes are possible in alternative embodiments.

In an exemplary embodiment, the plug housing 120 includes a mating chamber 154 that receives a portion of the receptacle connector 104. The mating chamber 154 is configured to receive the communication connector 110 when the plug connector 102 is mated with the receptacle connector 104. The mating chamber 154 is defined by the upper wall 146 and the side walls 150, 152. The mating chamber 154 is open at the front 140 to receive the communication connector 110. In an exemplary embodiment, the bottom 148 is open below the mating chamber 154. As such, the plug connector 102 has a lower profile by eliminating a lower wall below the mating chamber 154. Having the mating chamber 154 open at the bottom 148 allows mating of the plug connector 102 with the receptacle connector 104 having the communication connector 110 mounted flush to the circuit board.

In an exemplary embodiment, the plug housing 120 has a latch pocket 156 in the upper wall 146. The latch pocket 156 may be located proximate to the rear 142. The latch 130 is received in the latch pocket 156. Optionally, at least a portion of the cover 126 is received in the latch pocket 156. The cover 126 is coupled to the plug housing 120 to secure the latch 130 in the latch pocket 156.

Figure 3:
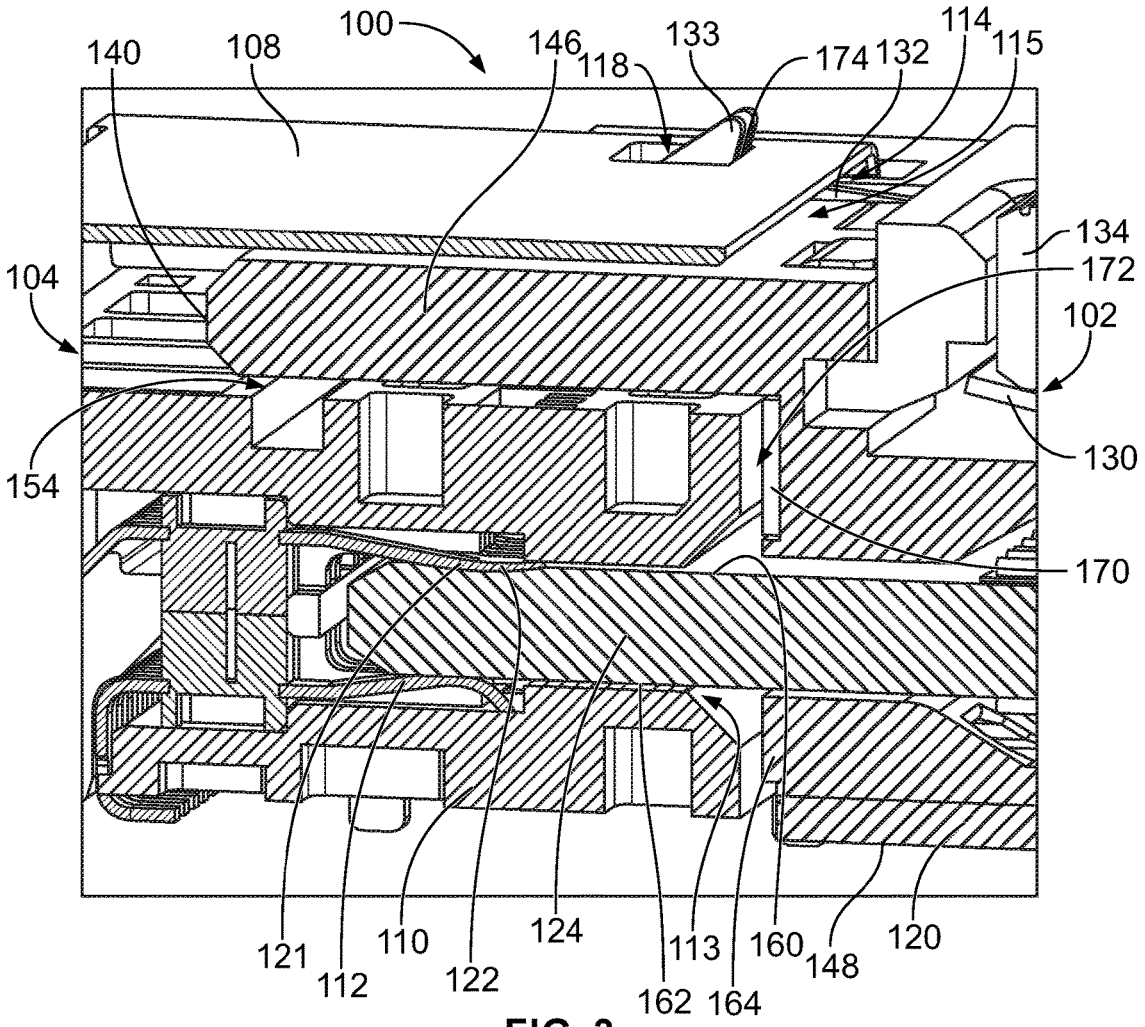
FIG. 3 is a cross-sectional view of a portion of the communication system in accordance with an exemplary embodiment showing a plug connector mated with a receptacle connector.

FIG. 3 is a cross-sectional view of a portion of the communication system showing the plug connector 102 mated with the receptacle connector 104. When mated, the plug connector 102 is received in the cavity 114 of the outer housing 108. When mated, the communication connector 110 is received in the mating chamber 154 at the front 140 of the plug housing 120. The upper wall 146 is positioned between the communication connector 110 and the outer housing 108. When mated, the circuit card 124 is received in the card slot 113. The receptacle contacts 112 are mated with the plug contacts 122. In an exemplary embodiment, the receptacle contacts 112 are provided along the top and the bottom of the card slot 113. The plug contacts 122 are provided along an upper surface 160 and a lower surface 162 of the circuit card 124. Other mating arrangements are possible in alternative embodiments.

The plug housing 120 includes an end wall 164 at the rear of the mating chamber 154. The end wall 164 extends from the upper wall 146 to the bottom 148. During mating, the end wall 164 may bottom out against the mating end 115 of the communication connector 110 to stop mating of the plug connector 102 with the receptacle connector 104. The end wall 164 bottoms out against the mating end 115 of the communication connector 110 prior to the circuit card 124 bottoming out against the communication connector 110 within the card slot 113 To prevent damage to the circuit card 124. When mated, the latch beam 132 of the latch 130 is received in the latch opening 118 of the outer housing 108. The latching tip 133 of the latch beam 132 extends through the latch opening 118 for latchably couple the plug connector 102 to the receptacle connector 104. The actuator 134 may be actuated to release the latch beam 132 from the outer housing 108.

In an exemplary embodiment, the communication system 100 includes a mating spring 170 positioned between the end wall 164 and the mating end 115 of the communication connector 110. The mating spring 170 presses the end wall 164 apart from the mating end 115. The mating spring 170 rearward biases the plug connector 102 relative to the receptacle connector 104 to a biased mating position. The mating spring 170 creates a gap 172 between the end wall 164 and the mating end 115 of the communication connector 110. In biasing or pressing the connectors 102, 104 apart, the plug contacts 122 are pulled rearward relative to the receptacle contacts 112. The receptacle contacts 112 are mated closer to the front ends 121 of the plug contacts 122 to reduce the lengths of electrical stubs of the plug contacts 122. In biasing or pressing the connectors 102, 104 apart, the latch beams 132 are set in the latch openings 118. For example, the latching tips 133 are pressed rearward against a latching edge 174 of the outer housing 108 defining the latch opening 118. The mating spring 170 insurers positive latching between the latch beam 132 and the outer housing 108 maintaining a biasing force on the plug connector 102 in a rearward direction to seat the latching tip 133 against the latching edge 174.

In an exemplary embodiment, the mating spring 170 is part of the plug connector 102. The mating spring 170 is coupled to the end wall 164 and engages the communication connector 110 when the plug connector 102 is mated with the receptacle connector 104. Alternatively, the mating spring 170 may be part of the receptacle connector 104, such as being coupled to the mating end 115 of the communication connector 110 configured to engage the plug connector 102 when the plug connector 102 is mated with the receptacle connector 104.

Figure 4:
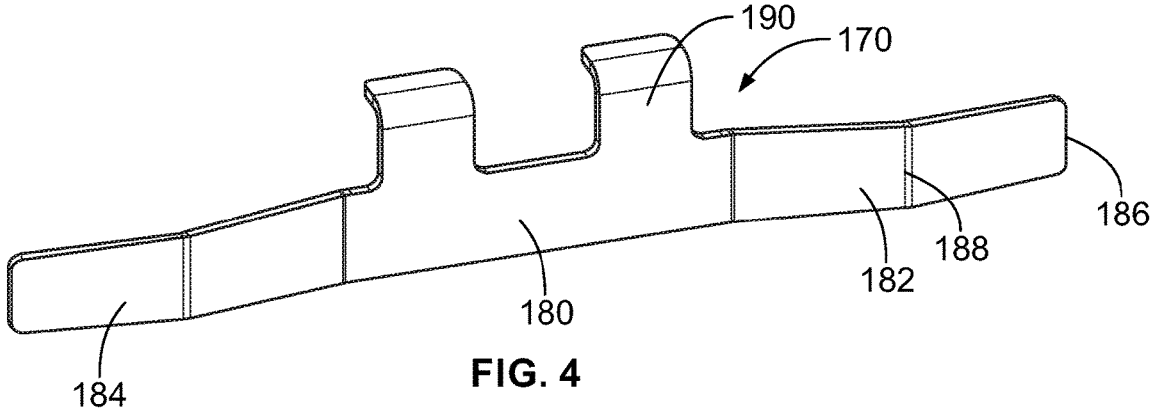
FIG. 4 is a front perspective view of a mating spring of the plug connector in accordance with an exemplary embodiment.

FIG. 4 is a front perspective view of the mating spring 170 in accordance with an exemplary embodiment. The mating spring 170 includes a base 180, a first spring arm 182 extending from a first side of the base 180, and a second spring arm 184 extending from a second side of the base 180. Each spring arm 182, 184 extends to a distal end 186 and has a mating interface 188 between the distal end 186 and the base 180. The spring arm 182, 184 may be bent or curved between the base 180 and the distal end 186. The spring arm 182, 184 is deflectable or compressible when the mating spring 170 engages the receptacle connector 104. In an exemplary embodiment, the mating spring 170 includes mounting tabs 190 extending from the base 180. The mounting tabs 190 are used to secure the mating spring 170 to the plug housing 120. Other types of springs may be used in alternative embodiments.

Figure 5:
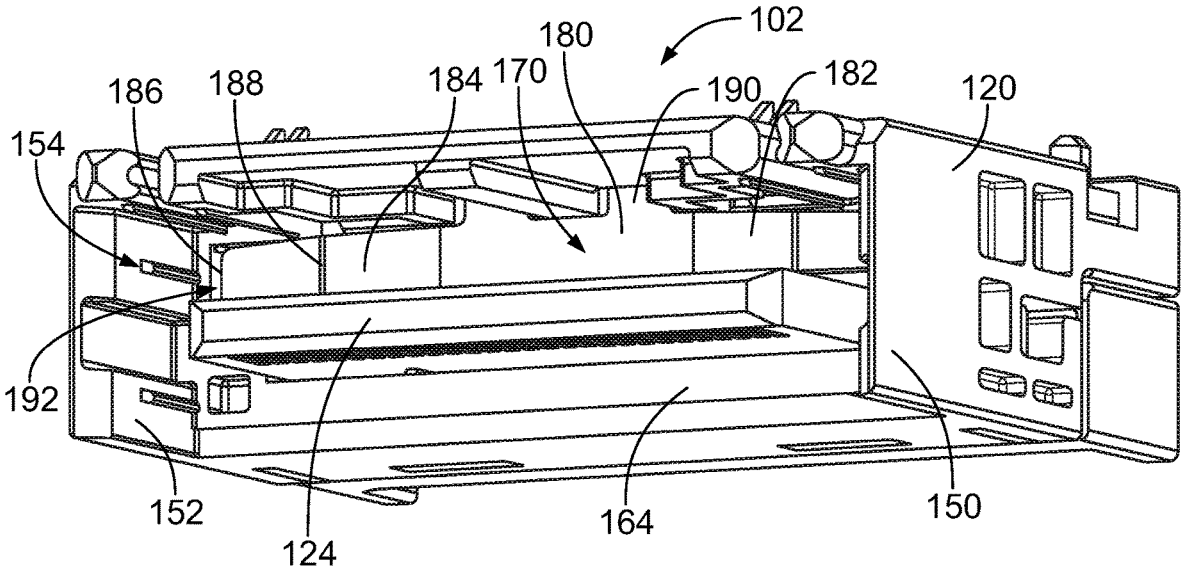
FIG. 5 is a front perspective view of the plug connector in accordance with an exemplary embodiment.
Figure 6:
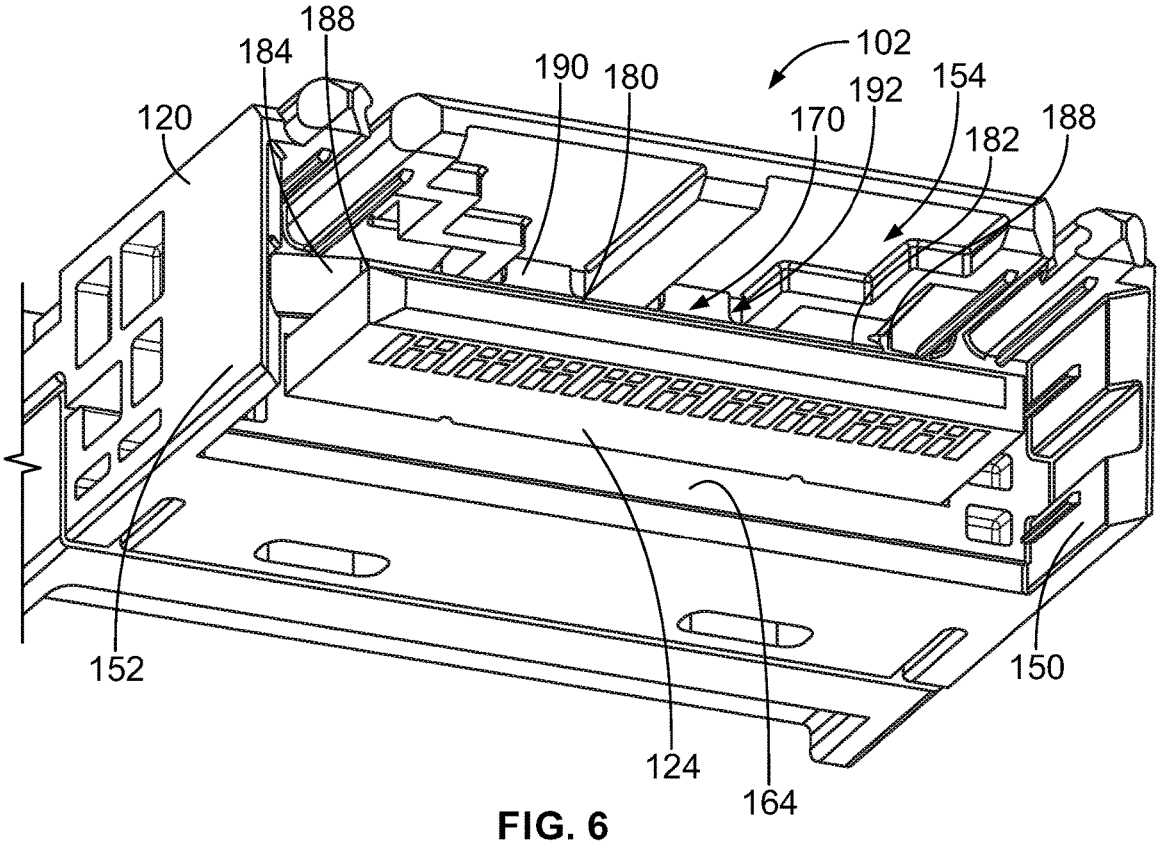
FIG. 6 is a bottom perspective view of the plug connector in accordance with an exemplary embodiment.

FIG. 5 is a front perspective view of the plug connector 102 in accordance with an exemplary embodiment. FIG. 6 is a bottom perspective view of the plug connector 102 in accordance with an exemplary embodiment. FIGS. 5 and 6 show the mating spring 170 in the mating chamber 154. In the illustrated embodiment, the mating spring 170 is located above the circuit card 124 at the end wall 164. The mounting tabs 190 are used to secure the mating spring 170 to the plug housing 120. Optionally, the end wall 164 may include a pocket 192 that receives the mating spring 170.

The spring arms 182, 184 extend from the base 180 into the mating chamber 154. The spring arms 182, 184 extend away from the end wall 164 to create a gap between the mating interface 188 and the end wall 164. The mating interface 188 is compressible toward the end wall 164 when the mating spring 170 engages the communication connector 110 of the receptacle connector 104. Optionally, the distal ends 186 of the spring arms 182, 184 engage the end wall 164 such that the mating spring 170 is supported by the end wall 164 at the base 180 and at the distal ends 186 of the spring arms 182, 184. Center sections of the spring arms 182, 184 are bowed outward away from the end wall 164 to position the mating interfaces 188 forward of the base 180 and the distal ends 186. The center sections of the spring arms 182, 184 are compressible when the mating spring 170 engages the communication connector 110.

With additional reference back to FIG. 3, the spring arms 182, 184 are configured to press the plug connector 102 rearward away from the communication connector 110. In an exemplary embodiment, the spring arms 182, 184 extend toward the first and second side walls 150, 152, respectively. The spring arms 182, 184 are configured to engage opposite sides of the mating end 115 of the communication connector 110 to center the communication connector 110 in the mating chamber 154 such that the end wall 164 is parallel to the mating end 115 of the communication connector 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A plug connector comprising:

a plug housing having a mating end at a front of the plug housing for mating with a mating connector, the plug housing having an upper wall, an end wall extending from the upper wall, and side walls extending from the upper wall, the plug housing having a mating chamber defined by the upper wall, the end wall and the side walls, the mating chamber being open at the front, the end wall being opposite the front at a rear of the mating chamber;

a circuit card held by the plug housing, the circuit card extending into the mating chamber for mating with the mating connector, the circuit card having plug contacts; and a mating spring coupled to the end wall, the mating spring having a spring arm extending into the mating chamber, the spring arm having a mating interface configured to engage a mating end of the mating connector to bias the end wall away from the mating end of the mating connector.

2. The plug connector of claim 1, wherein the mating spring holds the end wall spaced apart from a mating end of the mating connector.

3. The plug connector of claim 1, wherein the mating spring includes a base coupled to the end wall, the spring arm extending from the base into the mating chamber.

4. The plug connector of claim 1, wherein the side walls include a first side wall and a second side wall, the spring arm being a first spring arm, the mating spring including a second spring arm having a mating interface, the mating interface of the first spring arm located proximate to the first side wall, the mating interface of the second spring arm located proximate to the second side wall.

5. The plug connector of claim 4, wherein the first and second spring arms engage opposite sides of a mating end of the mating connector to center the mating connector in the mating chamber such that the end wall is parallel to the mating end of the mating connector.

6. The plug connector of claim 1, wherein the spring arm extends from a base of the mating spring to a distal end, the mating interface located between the base and the distal end, the distal end engaging the end wall.

7. The plug connector of claim 1, wherein the mating spring forces the plug contacts away from the mating connector.

8. The plug connector of claim 1, wherein the mating spring reduces electrical stub of the plug contacts.

9. The plug connector of claim 1, wherein the plug housing includes a latch pocket at the upper wall, the plug connector further comprising a latch received in the latch pocket, the latch having a latch beam including a latching tip configured to be received in a latch opening of the mating connector to secure the plug connector to the mating connector, the spring arm biasing the end wall away from a mating end of the mating connector to seat the latching tip against the mating connector within the latch opening.

10. The plug connector of claim 9, wherein the latching tip of the latch is located a first distance from the end wall, the plug contacts being located a second distance from the end wall, the latching tip engaging the mating connector to position the plug contacts relative to mating contacts of the mating connector.

11. The plug connector of claim 1, wherein the end wall includes a pocket receiving the mating spring.

12. The plug connector of claim 1, wherein the mating spring includes a mounting tab coupled to the upper wall.

13. The plug connector of claim 1, wherein a bottom of the plug housing includes an opening below the mating chamber.

14. The plug connector of claim 1, wherein the circuit card extends through the end wall, the plug connector further comprising a cable terminated to the circuit card rearward of the end wall.

15. A plug connector comprising:

a plug housing having a mating end at a front of the plug housing for mating with a mating connector, the plug housing having an upper wall, an end wall extending from the upper wall, and side walls extending from the upper wall, the plug housing having a mating chamber defined by the upper wall, the end wall and the side walls, the mating chamber being open at the front, the end wall being opposite the front at a rear of the mating chamber, the plug housing having a latch pocket at the upper wall;

a circuit card held by the plug housing, the circuit card extending into the mating chamber for mating with the mating connector, the circuit card having plug contacts;

a latch received in the latch pocket, the latch having a latch beam including a latching tip configured to be received in a latch opening of the mating connector to secure the plug connector to the mating connector; and a mating spring coupled to the end wall, the mating spring having a spring arm extending into the mating chamber, the spring arm having a mating interface configured to engage a mating end of the mating connector to bias the end wall away from the mating end of the mating connector to seat the latching tip against the mating connector within the latch opening.

16. The plug connector of claim 15, wherein the mating spring holds the end wall spaced apart from a mating end of the mating connector.

17. The plug connector of claim 15, wherein the side walls include a first side wall and a second side wall, the spring arm being a first spring arm, the mating spring including a second spring arm having a mating interface, the mating interface of the first spring arm located proximate to the first side wall, the mating interface of the second spring arm located proximate to the second side wall, the first and second spring arms engaging opposite sides of a mating end of the mating connector to center the mating connector in the mating chamber such that the end wall is parallel to the mating end of the mating connector.

18. The plug connector of claim 15, wherein the latching tip of the latch is located a first distance from the end wall, the plug contacts being located a second distance from the end wall, the latching tip engaging the mating connector to position the plug contacts relative to mating contacts of the mating connector.

19. A communication system comprising:

a receptacle connector including an outer housing having a cavity and a communication connector received in the cavity of the outer housing, the communication connector including a connector body holding receptacle contacts, the connector body including a card slot at a mating end of the communication connector, the receptacle contacts being arranged within the card slot, the outer housing including a latching feature including a latch opening; and a plug connector coupled to the receptacle connector, the plug connector including a plug housing having a mating end at a front of the plug housing for mating with the receptacle connector, the plug housing having an upper wall, an end wall extending from the upper wall, and side walls extending from the upper wall, the plug housing having a mating chamber defined by the upper wall, the end wall and the side walls, the end wall being opposite the front at a rear of the mating chamber, the mating chamber being open at the front to receive the communication connector, the plug housing having a latch pocket at the upper wall, the plug connector including a circuit card held by the plug housing, the circuit card extending into the mating chamber for mating with the card slot of the communication connector, the circuit card having plug contacts mated with the receptacle contacts, the plug connector including a latch received in the latch pocket, the latch having a latch beam including a latching tip received in the latch opening of the outer housing to secure the plug connector to the receptacle connector, and the plug connector including a mating spring coupled to the end wall, the mating spring having a spring arm extending into the mating chamber, the spring arm having a mating interface engaging the mating end of the communication connector to bias the end wall away from the mating end of the communication connector to seat the latching tip against the outer housing within the latch opening.

20. The communication system of claim 19, wherein the mating spring holds the end wall spaced apart from the mating end of the communication connector.

* * * * *